US008567747B2

(12) United States Patent
Wilson, Sr.

(10) Patent No.: US 8,567,747 B2
(45) Date of Patent: Oct. 29, 2013

(54) PORTABLE DRILLING PAD

(76) Inventor: Jack H. Wilson, Sr., Ridgeland, MS (US)

( * ) Notice: Subject to any disclaimer, the term of this patent is extended or adjusted under 35 U.S.C. 154(b) by 0 days.

(21) Appl. No.: 13/296,160

(22) Filed: Nov. 14, 2011

(65) Prior Publication Data

US 2013/0118386 A1 May 16, 2013

(51) Int. Cl.
*F16M 1/00* (2006.01)

(52) U.S. Cl.
USPC ..... 248/678; 248/346.01; 108/64

(58) Field of Classification Search
USPC ..... 108/64, 51.11, 161, 54.1; 248/346.07, 248/346.01, 678
See application file for complete search history.

(56) References Cited

U.S. PATENT DOCUMENTS 1,196,698 A * 8/1916 Keller ..... 108/161
1,430,392 A * 9/1922 Lukens ..... 106/164.6
3,922,413 A * 11/1975 Reineman ..... 428/119
4,056,251 A * 11/1977 Dixon et al. ..... 248/346.11
4,105,351 A * 8/1978 Anderson ..... 108/64
4,186,536 A * 2/1980 Piazza ..... 52/309.12
4,212,446 A * 7/1980 Domanick et al. ..... 248/346.03
4,689,257 A * 8/1987 Baum ..... 108/161
5,105,746 A * 4/1992 Reynolds ..... 108/56.1
5,149,050 A * 9/1992 Smith et al. ..... 248/679
5,333,830 A * 8/1994 Millen ..... 248/679
5,540,524 A * 7/1996 Gonsalves ..... 52/223.6
5,630,304 A * 5/1997 Austin ..... 52/384
5,664,394 A * 9/1997 Sweeney ..... 108/56.3
5,728,458 A * 3/1998 Sweeney ..... 428/312.4
5,890,437 A * 4/1999 Hill ..... 108/51.3
6,050,539 A * 4/2000 Millen ..... 248/678
6,227,515 B1 * 5/2001 Broyles ..... 248/678
6,474,245 B2 * 11/2002 Richard ..... 108/54.1
7,802,527 B2 * 9/2010 Dong ..... 108/56.1
D665,210 S * 8/2012 Hughes ..... D6/582
2003/0183741 A1 * 10/2003 Milner ..... 248/679
2007/0258767 A1 * 11/2007 Tapp ..... 404/36
2010/0024690 A1 * 2/2010 Phillips ..... 108/64
2011/0233363 A1 * 9/2011 Wold ..... 248/346.01
2011/0317095 A1 * 12/2011 Shimizu ..... 248/346.01

* cited by examiner

*Primary Examiner* — Jose V Chen
(74) *Attorney, Agent, or Firm* — Merek, Blackmon & Voorhees, LLC

(57) ABSTRACT

A drilling pad comprising a composite pad construction formed of layers of sheet metal, sheet rock, expanded metal and polymer emulsion and a spine formed of metal plate connected to the layers and fastening plates for joining pads to create a larger pad.

4 Claims, 4 Drawing Sheets

FIG. 4
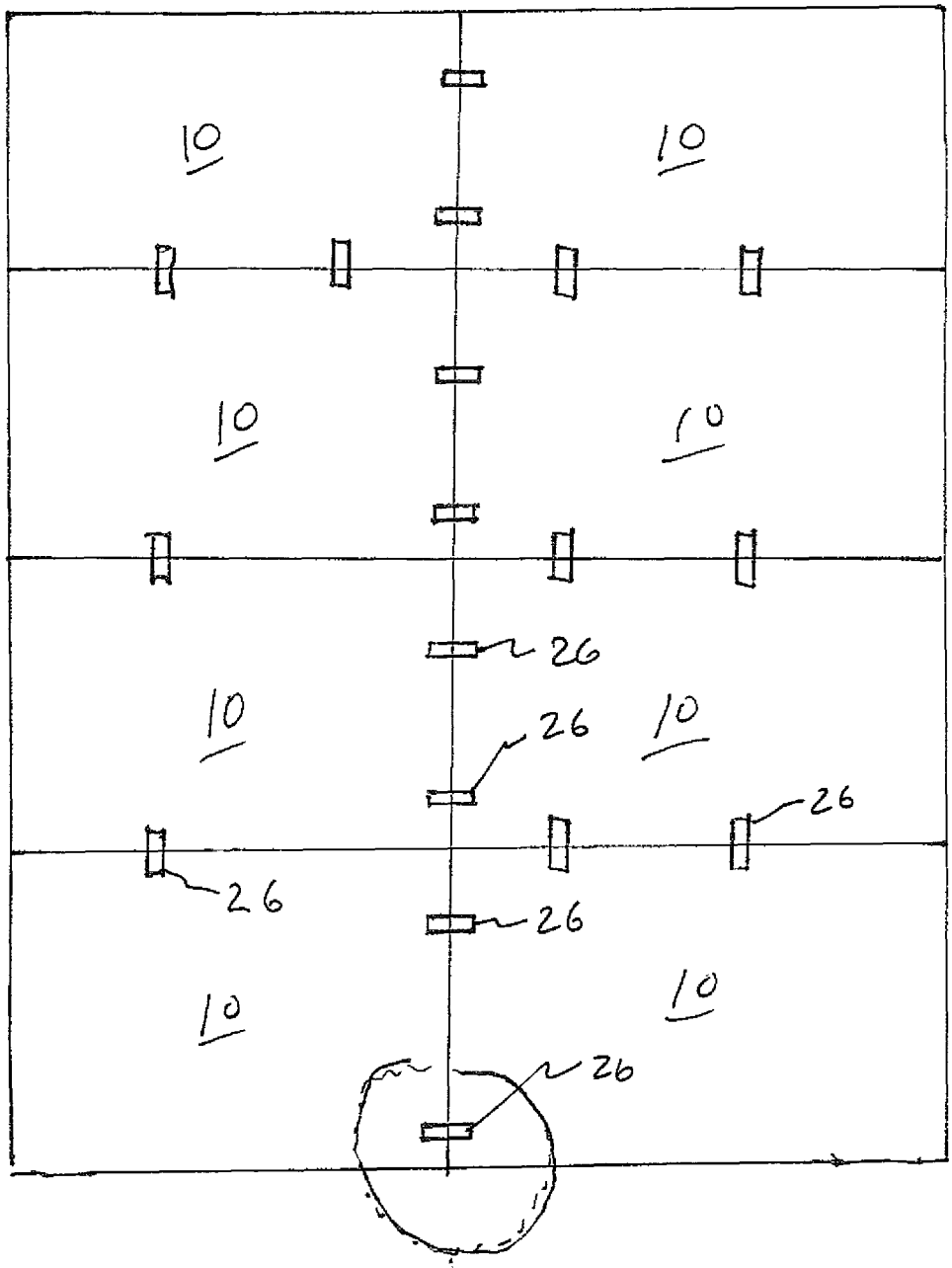
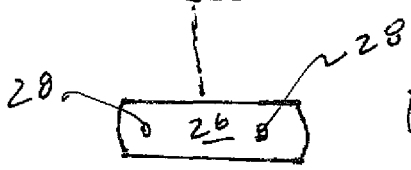
FIG. 5

PORTABLE DRILLING PAD

FIELD OF THE INVENTION

The present invention relates to pads for drilling rigs.

BACKGROUND OF THE INVENTION

Well drilling generally requires a drill rig and equipment and personnel. The area around land based drill rigs can become muddy when it rains and can be to soft to support trucks and other heavy equipment associated with the drilling process. Pads formed of wood planks are frequently used around land based drill rigs to provide a surface to support workers and equipment and prevent ground contamination.

It has been found that the use of planking does not provide a suitable surface due to the planking becoming slick with mud, water and oil. Oak is commonly used for planks and results in many oak trees being cut down unnecessarily. Furthermore, when the planks absorb oil, they create an environmental hazard.

In view of the foregoing it can be seen that there is a need for a new construction for well drilling pads that provide a safer and longer lasting support structure that avoids the use of wood products.

Additional objects and advantages of the invention will become apparent upon reading of the detailed description of the invention in conjunction with the accompanying drawings.

OBJECTS AND SUMMARY OF THE INVENTION

It is and object of the invention to provide a pad construction for use with drilling rigs;

Another object of the invention is to provide a portable pad construction;

Yet another object of the invention is to provide a composite pad construction;

Still another object of the invention is to provide a pad construction having a non-skid surface.

Yet another object of the invention is to provide a pad that includes a cementitious polymer emulsion layer with aggregate to provide a skid-resistant surface.

BRIEF DESCRIPTION OF THE DRAWINGS

FIG. 4 is a top view of multiple pads joined together.

FIG. 5 is an enlarged view of one of the connectors of FIG. 4.

In summary, the invention is directed to a drilling pad comprising a composite pad construction formed of layers of sheet metal, sheet rock, expanded metal and polymer emulsion and a spine formed of metal plate connected to said layers and fastening plates for joining pads to create a larger pad.

DETAILED DESCRIPTION OF THE INVENTION

Figure 1:
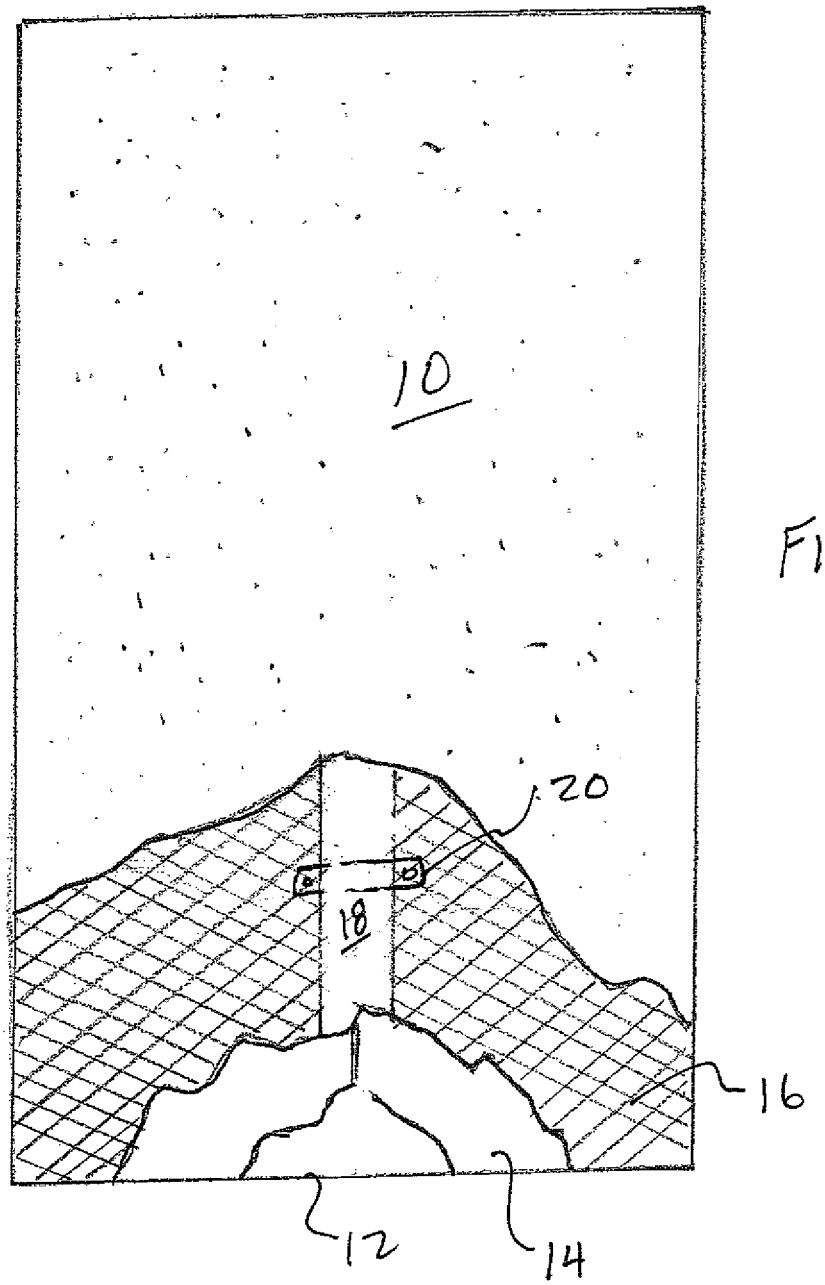
FIG. 1 is a top view of the pad construction with portions broken away to reveal the underlying layers.
Figure 2:
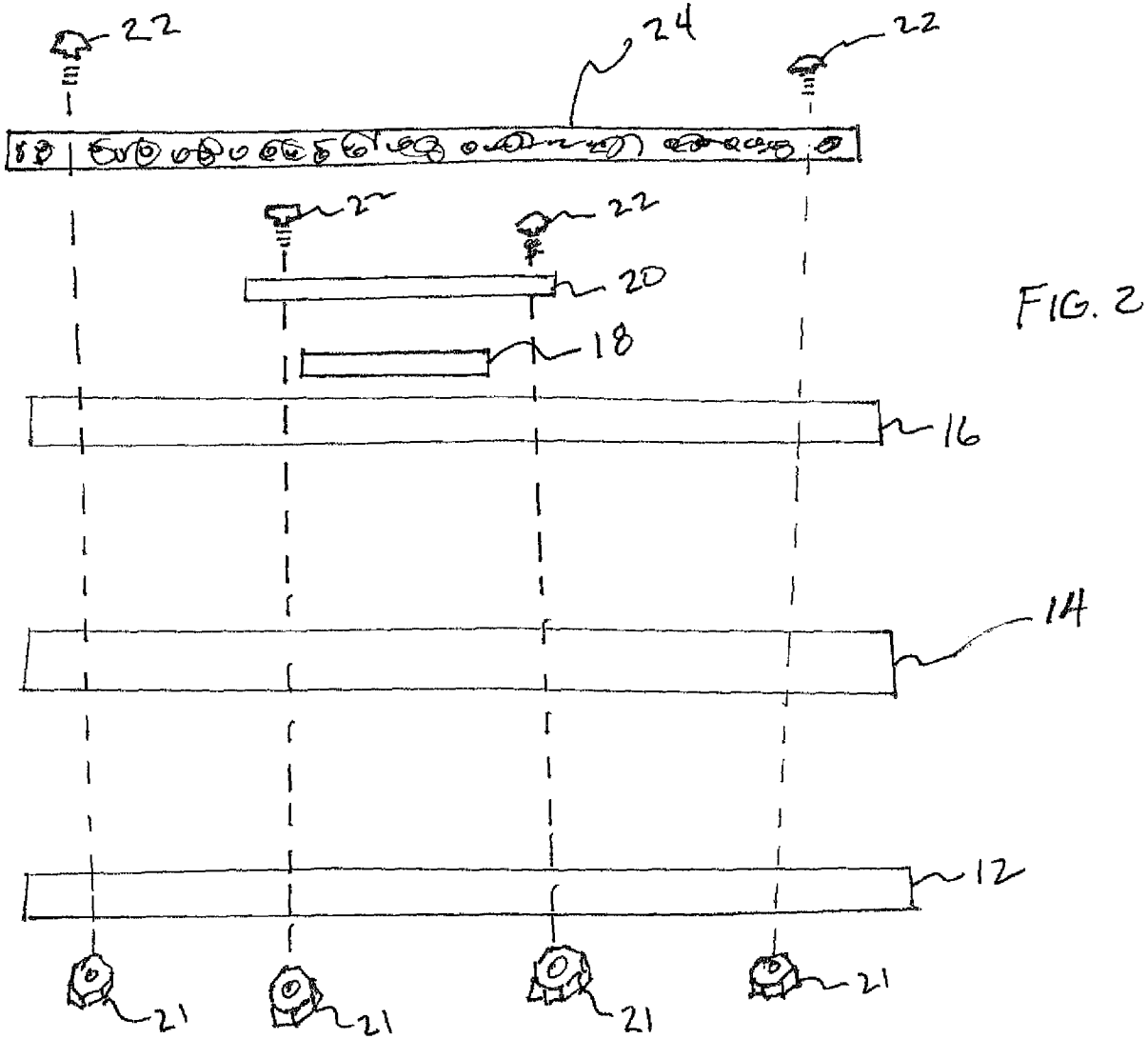
FIG. 2 is an exploded side view of the pad construction of FIG. 1.
Figure 3:
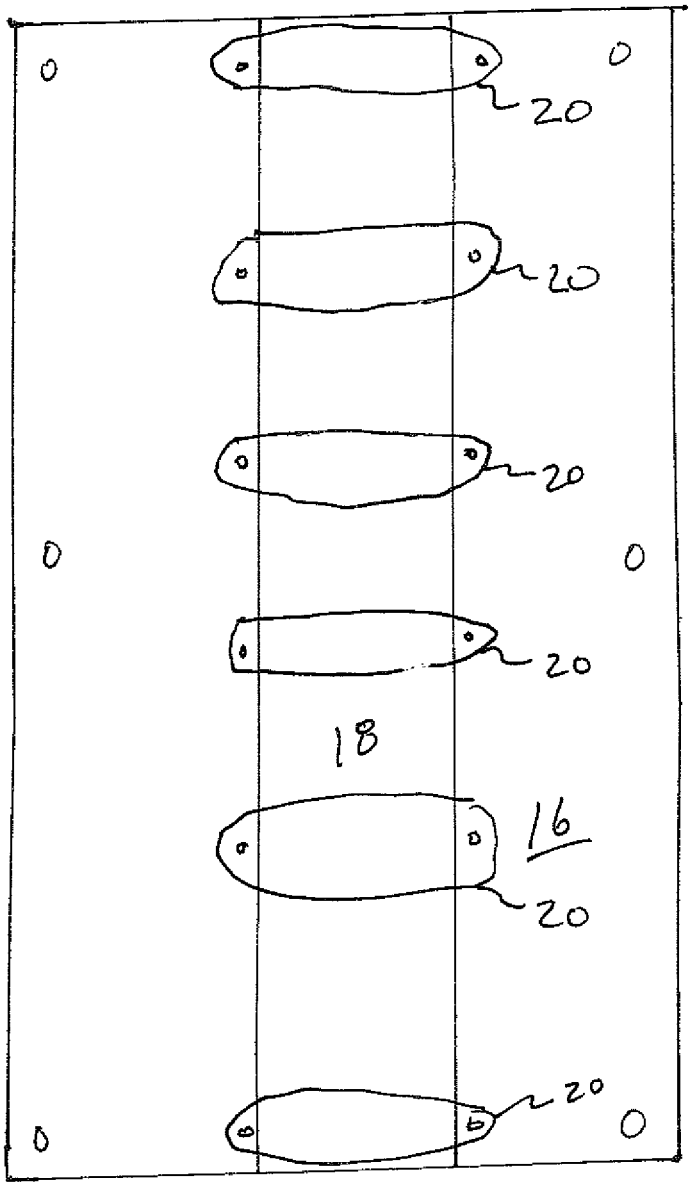
FIG. 3 is a top view of the pad construction before application of the polymer emulsion layer.

The invention will now be described with reference to FIGS. 1-5. In FIGS. 1 and 2 the pad 10 is shown being formed of several layers. The bottom layer 12 is preferably a ten foot by eight foot sheet of preferably ⅛ inch steel plate. The eight foot width allows the pad to be readily transported on trucks. The second layer 14 is preferably formed of two four foot by ten foot sheets of DUROCK® brand sheet rock. The third layer 16 is preferably formed of an eight by ten foot sheet of expanded metal which is perforated. On top of layer 16 is preferably a steel spine plate 18 of preferably ¼ inch thickness and three inches wide and ten feet long and is held in place by steel retaining plates 20 which are preferably ¼ inch by two inches by five inches. The steel retaining plates 20 are preferably spaces about two feet apart along the steel spine plate 16 and are held in place by nuts 21 and bolts 22. The location of the bolts 22 is shown in FIG. 3. A polymer emulsion layer 24 preferably formed of a mixture of a polymer resin such as Rohm & Haas 330 resin mixed with a cement such as QUIKRETE® and granite chips. The polymer emulsion is initially a liquid and is spread over the expanded metal sheet 16 and allowed to dry and forms a durable coating that can flex without cracking due to load stress from trucks and heavy equipment. The polymer emulsion layer 24 includes granite rock chips or sand to provide a high friction surface. The pads 10 are waterproof and can withstand exposure to oil, diesel fuel or gasoline. Coloring agents can be added to the polymer emulsion to provide a colored surface and can be whitened by adding titanium dioxide which can lessen solar heating and provide better visibility at night.

As shown in FIG. 4, multiple pads 10 can be joined together with fasteners 26 as shown in FIG. 5 to make a larger pad area. Fasteners 26 are formed of steel plate having holes 28 for receiving bolts 30. Seams 32 between the pads 10 can also be sealed by filling with the polymer emulsion.

The pads 10 constructed as described are not fragile and can withstand years of use.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

The invention claimed is:

1. A portable, composite drilling pad comprising:

a) a base layer formed of a steel plate about ten feet long by about eight feet wide and having a thickness of approximately ⅛ of an inch;

b) a second layer on top of said base layer, said second layer formed of two four by ten foot sheets of sheet rock;

c) a third layer on top of said second layer, said third layer formed of expanded metal having perforations therein;

d) a steel spine plate centrally located on top of said third layer, said steel spine plate having a thickness of about ¼ inch and a with of approximately three inches and extending substantially the length of the third layer;

e) a plurality of spaced apart retaining plates extending across said steel spine plate, each of said plurality of retaining plates being secured in place by a plurality of bolts extending through each of said retaining plates and through the third layer and the second layer and the base layer; and, a polymer emulsion layer formed of polymer resin and cement is located over said expanded metal layer and forms a durable flexible coating that can flex without cracking.

2. The portable, composite drilling pad as set forth in claim 1, further comprising:

a) a plurality of fastening plates formed of steel having a plurality of holes and bolts for joining adjacent portable, composite drilling pads together to create a larger composite pad.

3. The portable, composite drilling pad as set forth in claim 1, wherein:

a) said polymer emulsion includes granite chips to create a non-skid surface.

4. The portable, composite drilling pad as set forth in claim 1, wherein:

a) said polymer emulsion includes a coloring agent.

* * * * *